US009779585B2

(12) United States Patent
Dupuis et al.

(10) Patent No.: US 9,779,585 B2
(45) Date of Patent: Oct. 3, 2017

(54) MULTI-TOUCH USER INTERFACE FOR SCALING REWARD VALUE WITH RANDOM FAILURE THRESHOLD FOR GAMING SYSTEM

(71) Applicant: IGT CANADA SOLUTIONS ULC, Moncton (CA)

(72) Inventors: Reuben Dupuis, Moncton (CA); Stefan Keilwert, St. Josef (AT); Scott Edsall, Moncton (CA)

(73) Assignee: IGT CANADA SOLUTIONS ULC, Moncton (CA)

( * ) Notice: Subject to any disclaimer, the term of this patent is extended or adjusted under 35 U.S.C. 154(b) by 255 days.

(21) Appl. No.: 14/674,444

(22) Filed: Mar. 31, 2015

(65) Prior Publication Data

US 2016/0292969 A1 Oct. 6, 2016

(51) Int. Cl.
*G07F 17/32* (2006.01)

(52) U.S. Cl.
CPC ..... *G07F 17/3262* (2013.01); *G07F 17/3209* (2013.01); *G07F 17/3211* (2013.01); *G07F 17/3244* (2013.01); *G07F 17/3288* (2013.01); *G07F 17/3295* (2013.01)

(58) Field of Classification Search
None
See application file for complete search history.

(56) References Cited

U.S. PATENT DOCUMENTS 8,062,115 B2 * 11/2011 Thomas ..... G07F 17/32 463/16
8,219,937 B2 * 7/2012 Coddington ..... G06F 3/04883 345/173
2004/0116173 A1 * 6/2004 Baerlocher ..... A63F 9/24 463/16
2006/0097991 A1 5/2006 Hotelling et al.
2009/0191946 A1 * 7/2009 Thomas ..... G07F 17/32 463/20

(Continued)

OTHER PUBLICATIONS

EliteChromeGaming. Mario Party 10 Wii U: Balloon Blash Bash Mini Game [online]. Mar. 24, 2015 [retrieved Feb. 16, 2017]. Retrieved from the Internet: <URL:https://www.youtube.com/watch?v=6tLxjJON854>.*

(Continued)

*Primary Examiner* — Dmitry Suhol
*Assistant Examiner* — David Duffy
(74) *Attorney, Agent, or Firm* — Sage Patent Group

(57) ABSTRACT

A gaming system, and method of controlling a gaming system, having a touchscreen, that simulates a game of skill by showing a graphical object and detecting a pair of spaced-apart user input touch points on the touchscreen. An increase in distance between the touch points corresponds to an increase in stress upon the object, which is animated on the touchscreen, and scaling of an associated reward. A failure threshold is selected and the increase in stress is tested against the failure threshold. The failure threshold may be at least partly randomized. If the stress exceeds the threshold, then a failure event is shown. If the touch input ceases, the user may elect to accept then current reward value or to continue. The object may be a bubble and the stress may be expansion of the bubble, leading to popping of the bubble if the expansion exceeds the failure threshold.

20 Claims, 7 Drawing Sheets

(56) References Cited

U.S. PATENT DOCUMENTS

| | | | | |
|---|---|---|---|---|
| 2010/0083111 | A1* | 4/2010 | de los Reyes | G06F 3/0482 715/702 |
| 2010/0110932 | A1 | 5/2010 | Doran et al. | |
| 2011/0169750 | A1 | 7/2011 | Pivonka et al. | |
| 2015/0169122 | A1 | 6/2015 | Kulik et al. | |

OTHER PUBLICATIONS

International Search Report and Written Opinion relating to application No. PCT/CA2016/050333, dated Jun. 6, 2016.
Notification of Transmittal of the International Search Report and the Written Opinion of the International Searching Authority, or the Declaration, for PCT/CA2016/050333, dated Jun. 6, 2016.

* cited by examiner

MULTI-TOUCH USER INTERFACE FOR SCALING REWARD VALUE WITH RANDOM FAILURE THRESHOLD FOR GAMING SYSTEM

FIELD OF THE APPLICATION

The present application relates to multi-touch graphical user interfaces and, in particular, to control of graphical user interfaces in connection with gaming systems.

BACKGROUND

Modern casinos are increasingly moving toward electronic and computerized implementations for their gaming machines. An electronic gaming machine is typically programmed, via software or firmware, to pay out as winnings, in the long run, a particular percentage of the money that is paid in by players as wagers. This is typically done by setting the probabilities for individual payouts in the machine's control system.

Touchscreen technology provides a user interface for obtaining user input in selecting options or menu items. Touchscreens can also function to receive user input in controlling games of skill in a non-casino environment. However, games of skill are considered incompatible with commercial gaming equipment because of the necessity of controlling the target payout.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
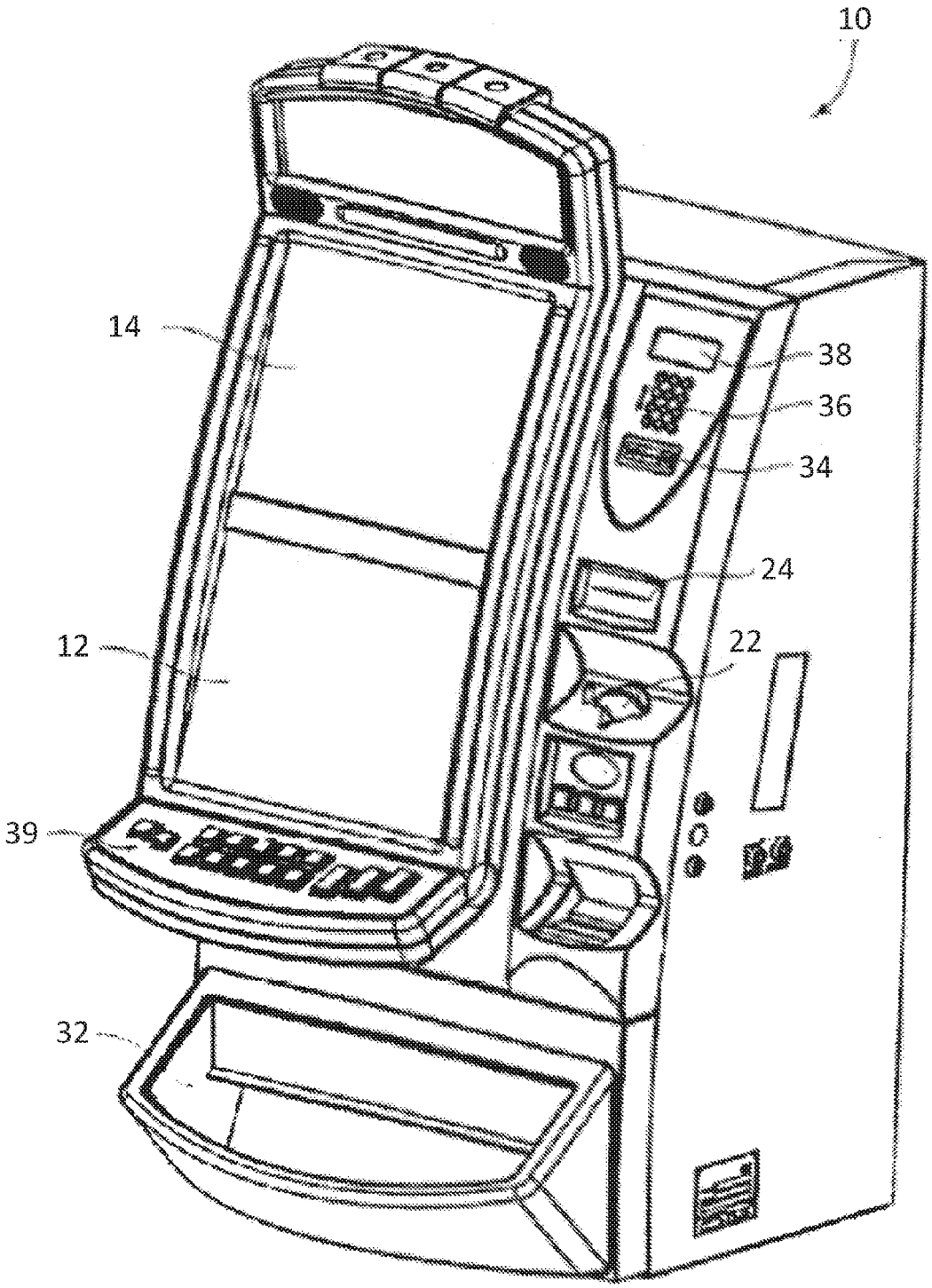
FIG. 1 is a perspective view illustrating an exemplary cabinet housing a casino game machine in accordance with some embodiments.

In one aspect, the present application discloses a method of controlling a gaming system, the gaming system having a touchscreen for displaying graphics and receiving user input. The method includes determining, using a processor, a randomized failure threshold; displaying a graphical image and an initial reward value on the touchscreen, wherein the graphical image represents an object; detecting two spaced-apart simultaneously occurring touch inputs on the touchscreen; while the two spaced-apart touch inputs are still detected on the touchscreen, detecting an increase in a distance between the two touch inputs and, in response, based on the increase in the distance, increasing a stress value and modifying the displayed graphical image to indicate increased stress on the object, scaling the reward value proportional to the increase in the distance, and determining whether the stress value exceeds the randomized failure threshold and, if so, zeroing the reward value and animating a failure event on the touchscreen; and, if at least one of the two spaced-apart touch inputs ceases to be detected on the touchscreen prior to the stress value exceeding the randomized failure threshold, displaying a selectable option to accept the scaled reward value In another aspect, the present application includes a gaming system. The gaming system includes a touchscreen; a processor; a memory; and a gaming application stored in the memory and executable by the processor, wherein, when executed, the gaming application causes the processor to determine a randomized failure threshold; display a graphical image and an initial reward value on the touchscreen, wherein the graphical image represents an object; detect two spaced-apart simultaneously occurring touch inputs on the touchscreen; while the two spaced-apart touch inputs are still detected on the touchscreen, detect an increase in a distance between the two touch inputs and, in response, based on the increase in the distance, increase a stress value and modify the displayed graphical image to indicate increased stress on the object, scale the reward value proportional to the increase in the distance, and determine whether the stress value exceeds the randomized failure threshold and, if so, zero the reward value and animate a failure event on the touchscreen; and, if at least one of the two spaced-apart touch inputs ceases to be detected on the touchscreen prior to the stress value exceeding the randomized failure threshold, display a selectable option to accept the scaled reward value.

In yet another aspect, the present application includes a processor-readable medium containing processor-executable instructions that, when executed, cause one or more processors to perform one or more of the methods described herein.

It should be appreciated that the description herein is by way of example only, and embodiments are not limited to providing any or all of the above-described functionality, although some embodiments may provide some or all of the functionality described herein.

The embodiments described herein can be implemented in any of numerous ways, and are not limited to any particular implementation techniques. Thus, while examples of specific implementation techniques are described below, it should be appreciated that the examples are provided merely for purposes of illustration, and that other implementations are possible.

In the present application, the term "and/or" is intended to cover all possible combination and sub-combinations of the listed elements, including any one of the listed elements alone, any sub-combination, or all of the elements, and without necessarily excluding additional elements.

In the present application, the phrase "at least one of . . . or . . . " is intended to cover any one or more of the listed elements, including any one of the listed elements alone, any sub-combination, or all of the elements, without necessarily excluding any additional elements, and without necessarily requiring all of the elements.

One illustrative application for the techniques described herein is for use in a system for controlling a casino game machine. However, techniques described herein may be applied to any type of gaming device having a touch-sensitive display screen, including but not limited to a casino game machine (e.g., a slot machine), a PC, a laptop, a tablet, a smartphone, etc. The present application may also use the term "touch points" to refer to locations on the screen at which a touch event is detected, such as a finger press. A pair of touch points refers to two distinct, spaced-apart, but simultaneously detected, touch events on the touchscreen.

The term electronic gaming machine (EGM) may be used herein to refer to a single-player gaming terminal. The terms EGM and gaming terminal may be used interchangeably herein. The gaming terminal may be implemented as a stand-alone physical device within its own cabinet in some embodiments. In other embodiments, the gaming terminal may be implemented in a common cabinet with other gaming terminals as part of an integrated set of EGMs. In one embodiment, one of the EGMs in the plurality of EGMs serves as the central controller. In some embodiments, the central controller may be server or other processing device. The central controller may be located proximate the EGMs or in a remote location.

An exemplary electronic gaming machine (EGM) 10 (i.e. gaming terminal) is illustrated in perspective view in FIG. 1. Exemplary EGM 10, as depicted in FIG. 1, includes a display 12 that may be a thin film transistor (TFT) display, a liquid crystal display (LCD), a cathode ray tube (CRT) display, a light-emitting diode (LED) display, an organic LED (OLED) display, an autostereoscopic three dimensional (3D) display, or any other type of display. In some embodiments, a second display 14 may provide game data or other information in addition to display 12. Display 14 may provide static information, such as an advertisement for the game, the rules of the game, pay tables, pay lines, and/or other information, and/or may even display the main game or a bonus game along with display 12. Alternatively, the area for display 14 may be a display glass for conveying information about the game. Display 12 may also include a camera for use, for example, in presenting an autostereoscopic 3D display. In some embodiments display 12 and display 14 are one physical screen and display 12 indicates a portion of the screen on which a game-related animated graphical user interface is rendered, while display 14 indicates a portion of the screen upon which a relatively static graphical user interface is rendered.

Display 12 and/or display 14 may have a touchscreen lamination that includes a transparent grid of conductors. A player touching the screen may change the capacitance between the conductors, and thereby the X-Y location of the touch on the screen may be determined. A processor within EGM 10 may associate this X-Y location with a function to be performed. There may be an upper and lower multi-touchscreen in accordance with some embodiments.

In some embodiments, a coin slot 22 may accept coins or tokens in one or more denominations to generate credits within the EGM 10 for playing games. An input slot 24 for an optical reader and printer may receive machine readable printed tickets and may output printed tickets for use in cashless gaming.

A coin tray 32 may receive coins or tokens from a hopper (not shown) upon a win or upon the player cashing out. However, in some embodiments, the EGM 10 may not pay in cash, but may only issue a printed ticket for cashing in elsewhere. Alternatively, a stored value card may be loaded with credits based on a win, or may enable the assignment of credits to an account associated with a computer system, which may be a network-connected computer.

A card reader slot 34 may accept any of various types of cards, such as smart cards, magnetic strip cards, and/or other types of cards conveying machine readable information. The card reader may read the inserted card for player and/or credit information for cashless gaming. The card reader may read a magnetic code on a conventional player tracking card, where the code uniquely identifies the player to the host system. In some embodiments, the code may be cross-referenced by a host system to any data related to the player, and such data may affect the games offered to the player by the EGM 10. The card reader may also include an optical reader and printer for reading and printing coded barcodes and other information on a paper ticket. A card may also include credentials that enable the host system to access one or more accounts associated with a user. The account may be debited based on wagers by a user and credited based on a win.

A keypad 36 may accept player input, such as a personal identification number (PIN) and/or any other player information. A display 38 above keypad 36 may display a menu for instructions and/or other information, and/or may provide visual feedback of the keys pressed. The keypad 36 may be an input device such as a touchscreen, or dynamic digital button panel, in accordance with some embodiments.

In some embodiments, player control buttons 39 may include any buttons and/or other controllers usable for the play of the particular game or games offered by the EGM 10, including, for example, a bet button, a repeat bet button, a spin reels (or play) button, a maximum bet button, a cash-out button, a display pay lines button, a display payout tables button, select icon buttons, and/or any other suitable button (s). In some embodiments, buttons 39 may be replaced by a touchscreen with virtual buttons. In some embodiments, touchless control gesture functionality may replace or coexist with buttons 39.

Figure 2:
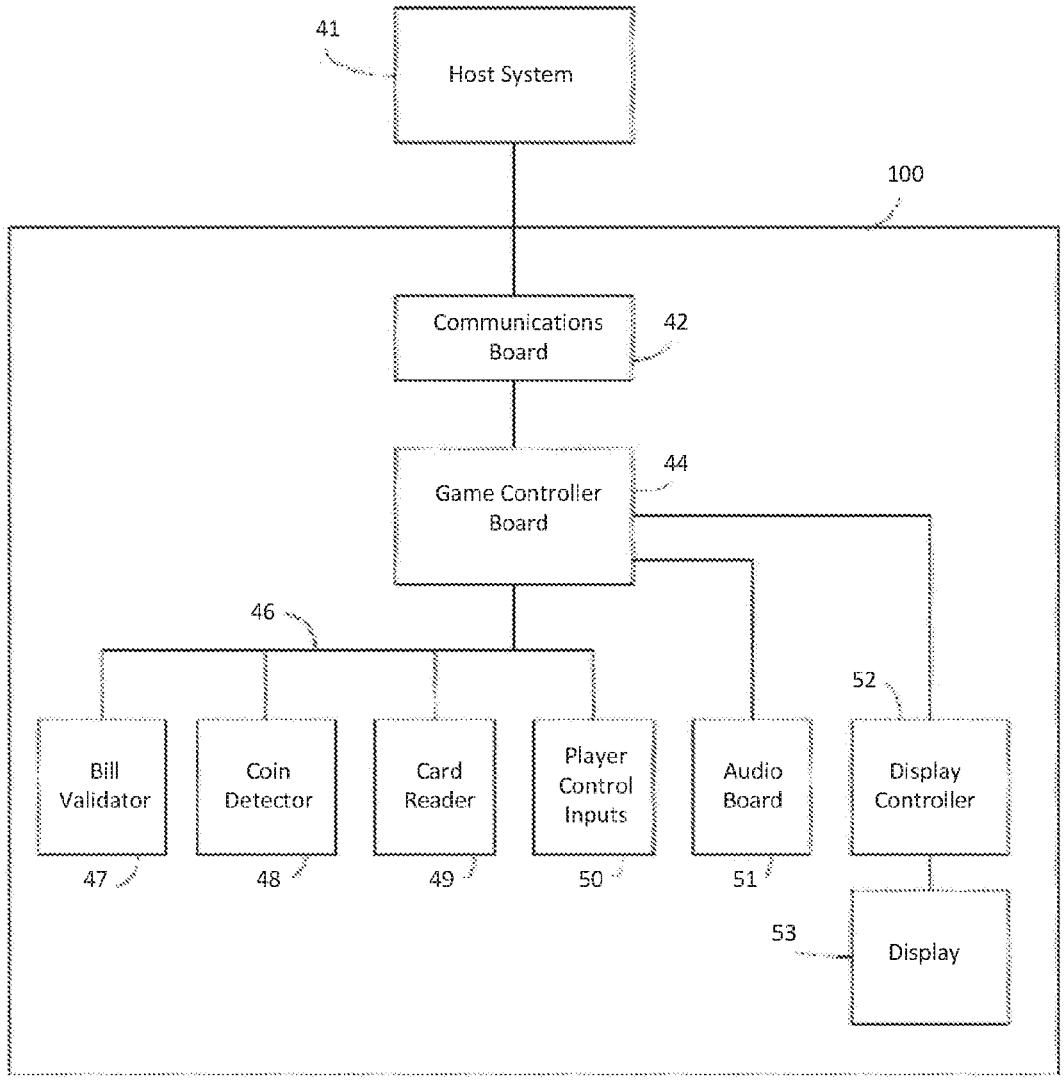
FIG. 2 is a block diagram of a casino game machine linked to a casino's host system in accordance with some embodiments.

FIG. 2 is a block diagram of one example of an EGM 100 linked to a host system 41. In the example shown, a communications board 42 may contain circuitry for coupling the EGM 100 to a local area network (LAN) and/or other type of network using any suitable protocol, such as the G2S protocols. Internet protocols are typically used for such communication under the G2S standard, incorporated herein by reference. Communications board 42 may transmit using a wireless transmitter, and/or may be directly connected to a wired network. Communications board 42 may set up a communication link with a master controller and may buffer data between the network and a game controller board 44. Communications board 42 may also communicate with a network server, such as in accordance with the G2S standard, for exchanging information to carry out embodiments described herein.

Game controller board 44 may contain memory and one or more processors for carrying out programs stored in the memory and for providing the information requested by the network. Game controller board 44 may execute programs stored in the memory and/or instructions received from host system 41 to carry out game routines.

Peripheral devices/boards may communicate with game controller board 44 via a bus 46 using, for example, an RS-232 interface. Such peripherals may include a bill validator 47, a coin detector 48, a smart card reader and/or other type of credit card reader 49, and/or player control inputs 50 (such as buttons 39 and/or a touchscreen).

Game controller board 44 may also control one or more devices that produce the game output including audio and video output associated with a particular game that is presented to the user. For example, audio board 51 may convert coded signals into analog signals for driving speakers. Display controller 52 may convert coded signals into pixel signals for one or more displays 53 (e.g., display 12 and/or display 14). Display controller 52 and audio board 51 may be directly connected to parallel ports on game controller board 44. In some embodiments, the electronics on the various boards may be combined in any suitable way, such as onto a single board.

Touchscreen displays present new opportunities to engage users in unique gameplay. Some gaming systems use touchscreens to solicit user selections, e.g. from a menu of options or to obtain input of a wager or other data. In these implementations, the touchscreen serves to obtain user selection from among available options in typically structured game play, e.g. to indicate whether to stop or continue, to request a card in a card game, to select a card for discard or otherwise, etc.

Touchscreen displays may also be used for user interaction in non-traditional game play, such as to guide the results or outcome of an action, e.g. whether a character "jumps" or "moves" and in which direction. These are more typically described as games of skill. Games of skill are commonplace in personal computing, and many can be found for smartphones, tablets, internet-based online games, etc. Users enjoy games of skill and the sense of personal accomplishment gained from succeeding at a game of skill. However, games that rely upon elements of personal skill to control an outcome through actions on a touchscreen are not compatible with commercial wager-based gaming, which must comply with a regulatory environment that governs payouts and outcomes.

In one aspect, the present application provides a gaming system with a touchscreen that mimics a game of skill but operates to decouple the outcome and consequent reward or failure from the predictability of a game of skill. In one aspect, the game of skill involves multi-touch input and measures a relative distance between two touch points. Changes in the relative distance correspond to the "stretching" or "loading" of a graphical image rendered on the touchscreen to simulate a real-world object under similar stretching or loading stress. Increased stress corresponds to an increased possibility of reward. A failure point at which the graphical image "fails" under the stress applied ends the game without reward. The graphic may be manipulated or animated to communicate the increased reward and the increased stress as the distance between the detected touchscreen inputs is increased.

In some embodiments, to prevent users from being able to accurately predict the failure point, and thus determine the outcome, the gaming system game may alter either or both the failure threshold at which the reward is cancelled, or the rate of scaling of the reward value with the increase in stretching or loading. In some embodiments, the failure threshold and/or the rate of scaling of the reward value are selected based on a probabilistic model that takes into account a history of winnings, either from the individual gaming system or from a network of interconnected gaming systems, and a target payout (e.g. an average winnings per play over time).

Figure 3:
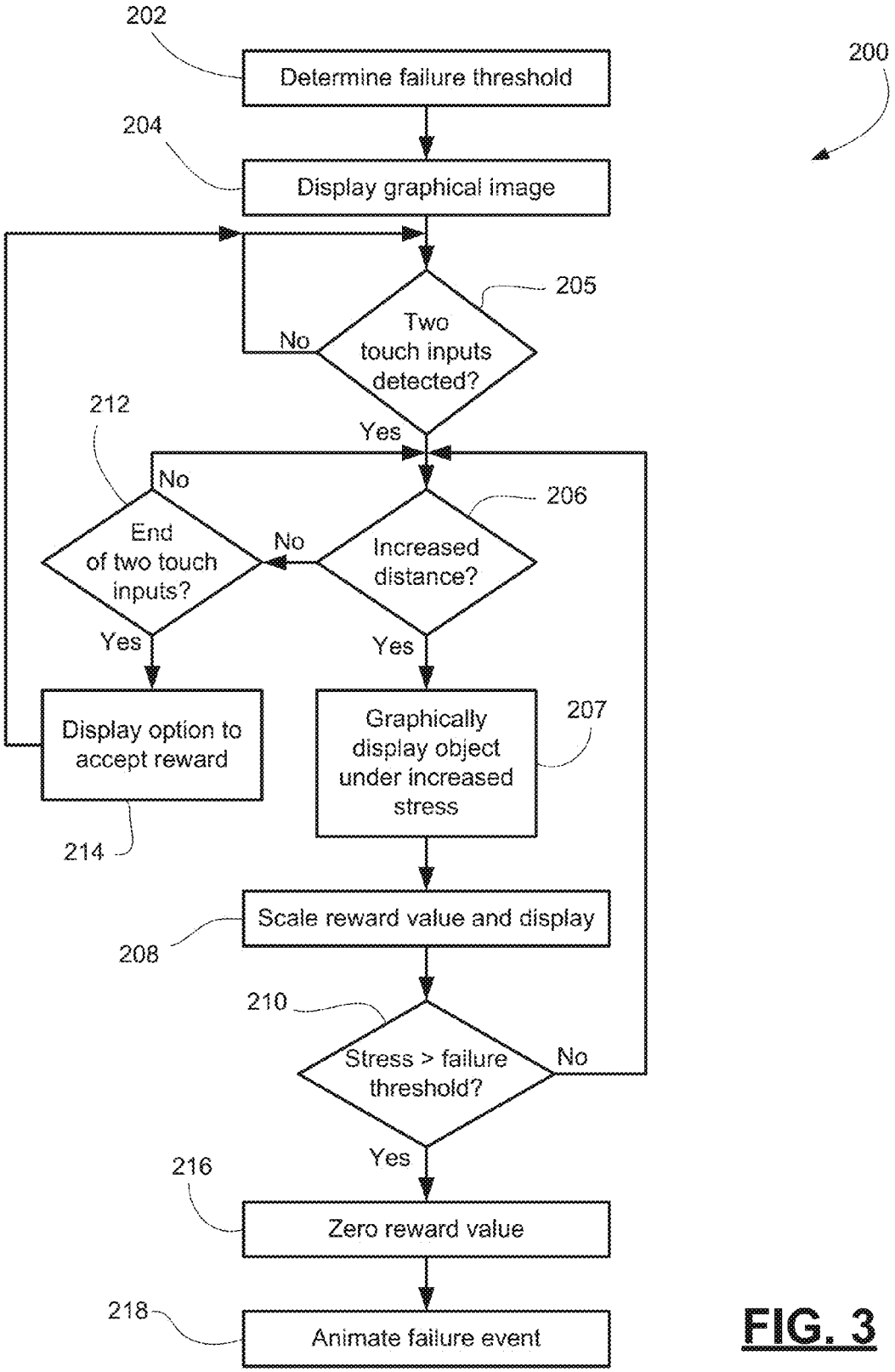
FIG. 3 is a flowchart showing one example method of controlling a gaming system.

Reference is now made to FIG. 3, which shows, in flowchart form, one example method 200 for operating a multi-touch game. The example method 200 is applied to wager-based gaming implemented using a touchscreen interface for displaying game-related graphics, images and animations, and for receiving user input/selections. The method 200 may be at least partly implemented by software executed by one or more processors or microcontrollers forming part of the gaming systems or a networked gaming system. The method 200 in this example involves increasing a stress on a graphical object, which stress may be represented by stretching, loading, compressing, or some other model of real-world forces upon an object. The method 200 further involves a breaking or failure point at which the stress causes the object to fail, e.g. pop, collapse, break, or otherwise lose its structural integrity due to the applied stress level.

The method 200 includes an operation 202 of determining a failure threshold. The failure threshold may, in some embodiments, be a measure or value beyond which the graphical object fails under stress. As an example, if the object being modeled graphically is a band or rope and the stress applied is stretching, then the failure point may be stretched distance value or an applied force value (e.g. corresponding to modeled Newtons of force) at which the object fails (e.g. snaps or breaks). As another example, if the object being modeled is a plank or board or bridge spanning some gap and the stress being applied is the loading of the plank or board or bridge, then the failure point may be an applied weight or a distance of deflection of the plank or board or bridge under the load that causes the plank or board or bridge to fail (e.g. collapse, buckle, break, etc.). Many other real-world objects and possible stresses may be modeled in other examples.

The operation 202 of determining the failure threshold is at least partly randomized. That is, the failure threshold may be determined, at least partly, based on a random or pseudo-random number selection. The selection may be constrained by a maximum value applicable to the graphical object and the display space. For example, if the graphical object is a rope and the failure point is the distance stretched, the failure point may be selected so as to ensure that the failure point occurs within a stretched distance that still maintains the ends of the rope visible upon the display screen. In some embodiments, the selection may further be constrained by a minimum value so as to avoid immediate failure of the object.

The failure threshold determination may further be based, at least in part, upon a target payout and a history of payouts. The history of payouts may reflect the winning rate (dollars per play) of the current gaming system over a selected time period in some embodiments. The history of payouts may reflect the winning rate of a plurality of gaming systems connected in a networked environment so as to balance the winning rates across a number of systems, for example in a casino environment, in some embodiments. The target payout may prescribe a winning rate and the random number selection may be constrained to ensure that the history of payouts converges to the prescribed winning rate over time. That is, if the history of payouts indicates a higher-than-prescribed winning rate, the randomize failure threshold may be skewed towards lower thresholds so as to reduce the winning rate over time, but still having a randomized element so as to avoid user prediction and encourage heightened acceptance of risk by the user during game play.

In operation 204, the gaming system displays a graphical image representing the real-world object (sometimes referred to herein as the "graphical object") to be stretched or loaded and an initial reward value. The initial reward value may be represent in "points" or in currency, in some embodiments. The initial reward value may appear in or on the graphical object. In some cases, the initial reward value may be rendered elsewhere on the display screen, such as in a toolbar, menu, sidebar, header, or in other locations on the screen. The graphical object or other portions of the screen may feature an idle-state animation to indicate to the user that the system awaits user input in some embodiments. In some embodiments, instructions may be also be displayed on the screen.

The system then monitors the touchscreen in operation 205 to assess whether it detects two spaced-apart simultaneous touch events on the screen. A single touch event, e.g. one finger, does not satisfy the test of operation 205. Subsequent detection of another touch event in another location on the screen will also not satisfy the operation 205 if the first touch event has ended. In some embodiments, there may be minimum distance on the screen between the detected touch events that is required before the test of operation 205 is satisfied, for example to ensure the two touch events are distinguishable and not a mistake by the user by using two fingers of the same hand. The multi-touch event may be implemented using a digit from each hand of the user, or by using a thumb and finger (e.g. index finger) of one hand. In some embodiments, the gaming system may be configured to graphically indicate to the user that the two spaced-apart touch events have been detected, such as by animating the graphical object or other portions of the screen, or by displaying an animated or graphical image connecting the two touch points, or by displaying an animation or image under each of the two touch points.

Once the two touch points have been detected in operation 205, then in operation 206 the system monitors the distance between the points to determine whether it has been increased, i.e. whether the user has slid one or both of his or her fingers on the screen so as to widen the distance between them while maintaining contact with the touchscreen. If so, then in operation 207 the gaming system graphically indicates a corresponding increase in the stress upon the graphical object. In some embodiments, the graphical indication of stress may include stretching the object (e.g. elongating or expanding the object). In some embodiments, it may involve graphically rendering additional load upon the object (e.g. objects weighing upon a plank or bridge), or graphically deflecting/bending the object. Other examples of animating or illustrating the effects of added stress are dependent upon the nature of the graphical object and the stress event being modelled.

The rate of increase of the stress value (e.g. distance stretched, load added, etc.) may be directly linked to the increase in distance between the touch points in some embodiments. In some embodiments, the like between the increase in stress value and the increase distance may be proportional, i.e. the increase in stress value corresponds to the increase in distance times some non-negative multiplier A. In some cases, the increase in stress value may be based on a relative increase in the distance that accounts for the original distance between the touch points, i.e. a 10% increase in the original distance between touch points corresponds to an A·10% increase in the stress value, where A is a non-negative multiplier. Other mathematical relationships between the increase in distance and the increase in the stress value may be established.

An element of randomness may be introduced to the relationship between distance and stress value. For example, in one embodiment, the gaming system may select the multiplier A using a randomized selection process. A may be constrained between a maximum and minimum and a random number generation process may be used to select A between the max and min. In some cases, the random number generation process may be a pseudo-random number generation process.

In some embodiment, the relationship between the increase in the stress value and the increase in the distance may be non-linear. For example, the increase in stress value may start slowly and accelerate as the distance increases. In one example, the stress value is proportional to the increase in distance squared.

The increase in stress value may be represented on the screen by a corresponding animation of the graphical object, e.g. by stretching, deflection, compression, etc. In some cases, the degree of stretching, deflection, etc., of the graphical representation on the screen may not correspond directly to the underlying stress value. In some cases, animations may be used to illustrate the increasing stress value. For example, an increase or amplification of jitter, shudder, wobble, etc. In some cases, the degree to which the increase in stress is represented by a corresponding change in the graphically rendered object, whether through stretching, compression, deflection, wobble, etc., incorporates some randomness so that the visual cues do not directly correspond to the increase in stress value.

The gaming system also scales and displays the reward value, as indicated by operation 208. As with the increase in the stress value, the increase in the reward value may be linked to the increase in distance using various possible mathematical relationships, and may include an element of randomness, for example through a partly random multiplier relationship. The rate of increase in reward value is not necessarily the same as the rate of increase in stress value. The relationship between the rate of increase of reward value and the rate of increase in distance between the touch points may be linear or non-linear.

As noted above, the rate of scaling may be selected by the gaming system at least partly in order to influence the likely payout, and thereby ensure the history of payouts converges over time to a desired payout. In other words, the scaling may be altered to reduce the rate at which the reward value increases if the current payout rate exceeds the target payout, thereby decreasing the expectation value of the outcome.

In some embodiments, the increase in the reward value, in addition to being displayed numerically on the screen, is illustrated graphically by scaling the size of the numbers.

In operation 210, the gaming system assesses whether the stress value has exceeded the failure threshold. In some instances, the failure threshold may indicate a maximum stretched length/size for the graphical objection, a maximum load upon the object, a maximum force applied to the object, etc. If not, then the method 200 returns to operation 206 to monitor for further increases in the distance between the touch points.

It will be appreciated that operations 207, 208 and 210, although shown as being sequential, may be carried out in a different order or at substantially the same time in various other implementation.

At some point during the process, the user may lift one or both fingers, thereby eliminating one or both of the detected touch points, as indicated by operation 212. If one or both of the two touch points are no longer detected, then the gaming system may display a selectable option to accept the current reward value, as shown by operation 214. If the user opts to select the reward value, then the user's account is credited with the reward value (points or currency) and the game ends. Otherwise, the gaming system continues to monitor for whether the user wishes to continue the game by reapplying two touch points on the screen, as in operation 205. The 'stressed' state of the graphical object and the increased reward value remains the same in the cases and the user has the option of trying to apply further stress to increase the reward value. The new touch points need not necessarily be the same as the old touch points in some embodiments.

In the event that the failure threshold is found to have been exceeded in operation 210, then in operations 216 and 218 the gaming system zeros the reward value and animates a failure event. The failure animation may be dependent upon the nature of the graphical object, e.g. a rope snapping or breaking, a structure buckling or breaking, an expanded object popping, etc.

Reference will now be made to FIGS. 4 to 9, which illustrate an example graphical user interface (GUI) 300 for a gaming system having a touchscreen. In this illustrative example, the graphical image or object is of a bubble, e.g. a soap bubble or the like. The stress applied is the stretching/expansion of the bubble, with the failure event being the popping of the bubble. It will be understood that the bubble example is illustrative and that the present application is not necessarily limited to bubbles.

Figure 4:
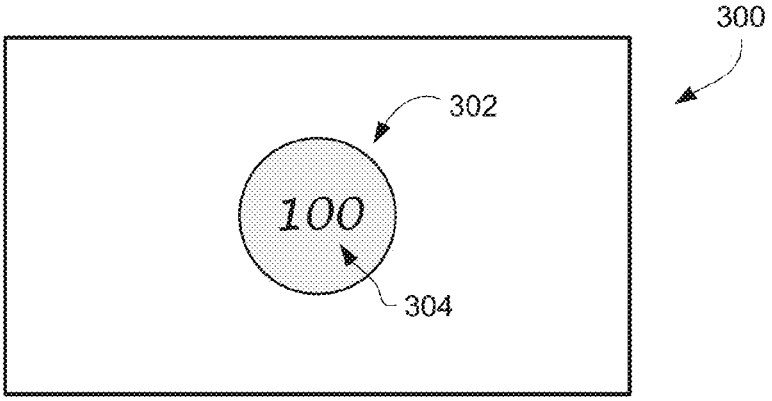
FIGS. 4 to 9 shows examples of a graphical user interface rendered in accordance with one example implementation of a gaming system.

FIG. 4 diagrammatically shows the example GUI 300 with a bubble 302 depicted in a first state, i.e. an idle or start state. An initial reward value 304, in this example case the number '100', is rendered on the GUI 300. In this example, the initial reward value 304 is shown inside of the bubble 302. Instructions (not shown) to guide the user to initiate the game play may be rendered on the screen or may be audio output through a speaker. In some embodiments, the bubble 302 may be animated while in the idle/start state. For example, its surface may be rendered as shimmering, so as to give the bubble 302 an sense of realism and to indicate to the user that the gaming system is active and awaiting user input.

Figure 5:
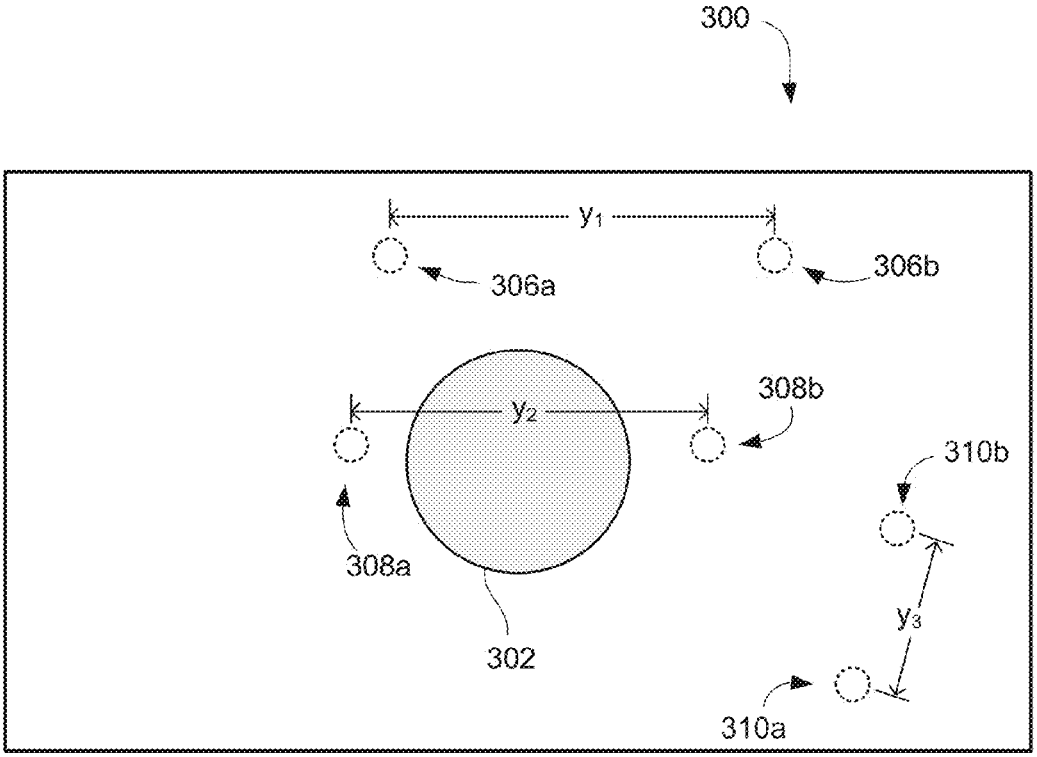

In FIG. 5, the GUI 300 illustrates example pairs of touch points. It will be understood that any two points on the touchscreen within the GUI 300 may serve as a pair of touch points and the examples illustrates are not limiting in terms of the location of possible pairs of touch points. A first pair of touch points 306*a*, 306*b* is shown above the bubble 302. The first pair of touch points 306*a*, 306*b* is a distance $y_1$ apart. Another pair of possible touch points 308*a*, 308*b* is shown on either side of the bubble 302 a distance $y_2$ apart. Yet another pair of possible touch points (in this example, a non-horizontal pair) 310*a*, 310*b* is shown to the side of the bubble 302. The touch points 310*a*, 310*b* are a distance $y_3$ apart. It will be appreciated that the pair of touch points need not be on either side of the graphical object (in this example, the bubble 302).

Figure 6:
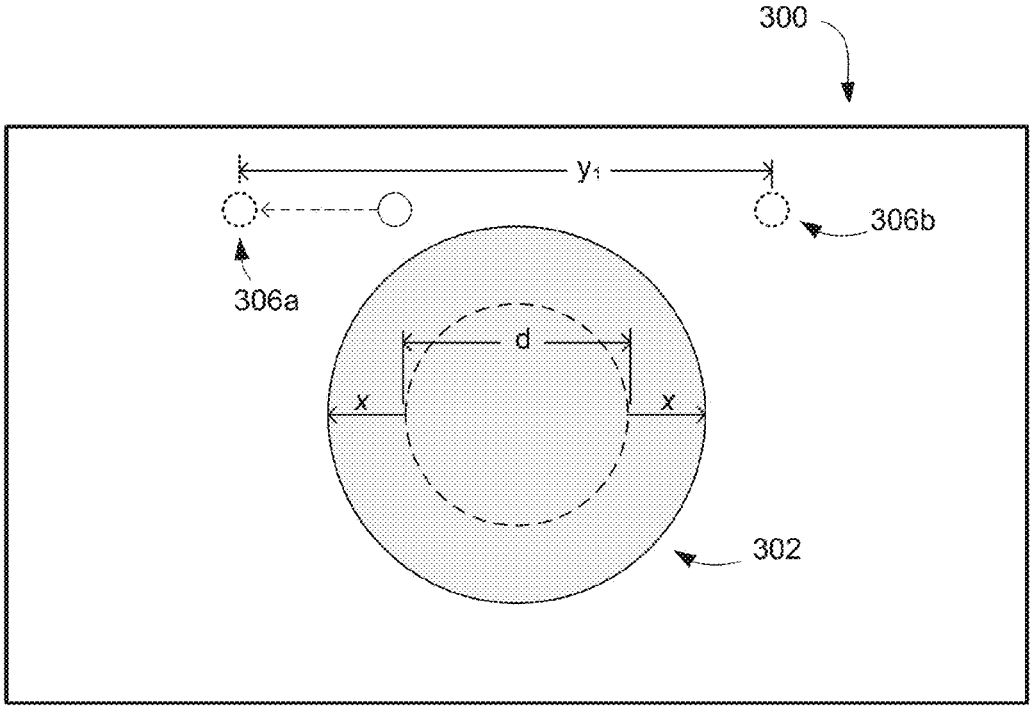

FIG. 6 illustrates the expansion of the bubble 302 based on an increase of distance between a pair of touch points, which in this case is the first pair of touch points 3061, 306*b*. In this example, the touch point 302*a* has been moved (slid) to the left to increase the distance $y_1$. The bubble 302 is now shown inflated in size. It originally had a diameter of d. Based on the increase in the distance $y_1$, the bubble 302 now has a diameter of d+2x. As discussed above, the expansion x may be mathematically linked to the absolute or relative increase in the distance $y_1$. The relationship may be linear or non-linear. The relationship may further involve a randomly-selected multiplier or other scaling factor.

Figure 7:
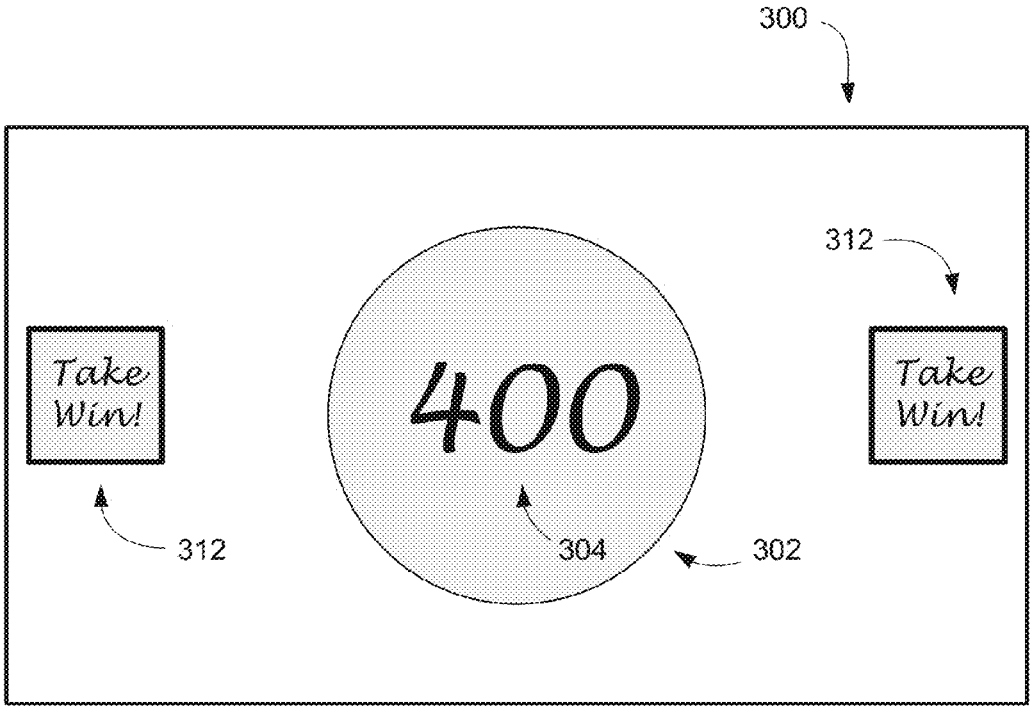

Reference is now made to FIG. 7, which shows the GUI 300 in a situation in which the user has released one or more of the touch points, i.e. the gaming system no longer detects the pair of touch points. In this case, the gaming system offers, through the GUI 300, a selectable option to accept the current reward value 304. In this example, the GUI 300 provides two soft buttons 312 that may be selected via the touchscreen to accept the current reward value 304, which is shown as '400'. The bubble 302 is maintained or held in its expanded state. Various animations may be optionally be applied to indicate that the bubble 302 is at risk of breaking from further expansion, such as shaking or wobbling animations. It will be noted that the reward value 304 is rendered in an expanded size font.

Figure 8:
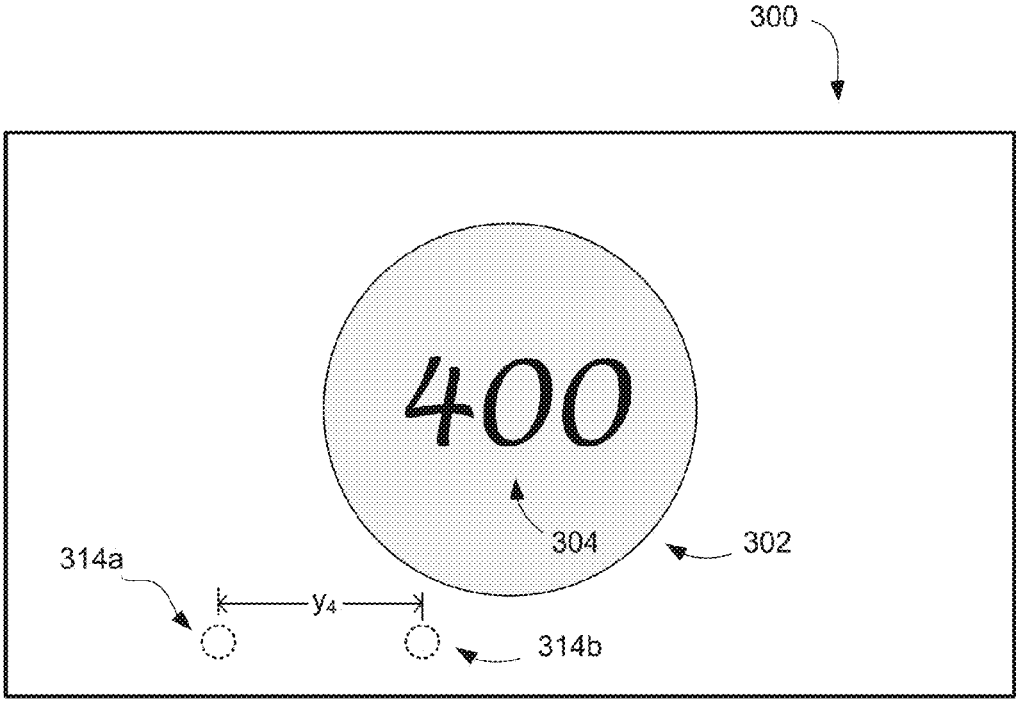

FIG. 8 shows the GUI 300 if the user opts to continue by reasserting a pair of touch points 314*a*, 314*b*. The new pair of touch points 314*a*, 314*b* need not be the same as the previously-used pair, or be in the same location, in this example. The touch points 314*a*, 314*b* are a distance $y_4$ apart.

In some embodiments, the touch points may only be used to increase the stress upon the graphical object. In this particular example, increasing the distance between touch points increases the expansion of the bubble 302, but decreasing the distance (either the increased or original distance) does not decrease the expansion of the bubble 302. In other words, the expansion of the bubble 302 may not be retracted, it may only be increased. In some embodiments, if a user moves the two touch points closer together, for example from a distance y to a distance y-z, then the gaming system will interpret any subsequent increase of the distance y-z as an increase that increases the size of the bubble 302 (and the reward value, etc.). This produces a ratcheting effect in that the user may expand and contract the touch points causing an increase in bubble size with each expansion, but no corresponding decrease in bubble size with each contraction of the touch points. In some other embodiments, once a user has contracted the touch points to the distance y-z, then the system will only interpret subsequent increase of the distance beyond the distance y as an increase that increases the size of the bubble 302.

Figure 9:
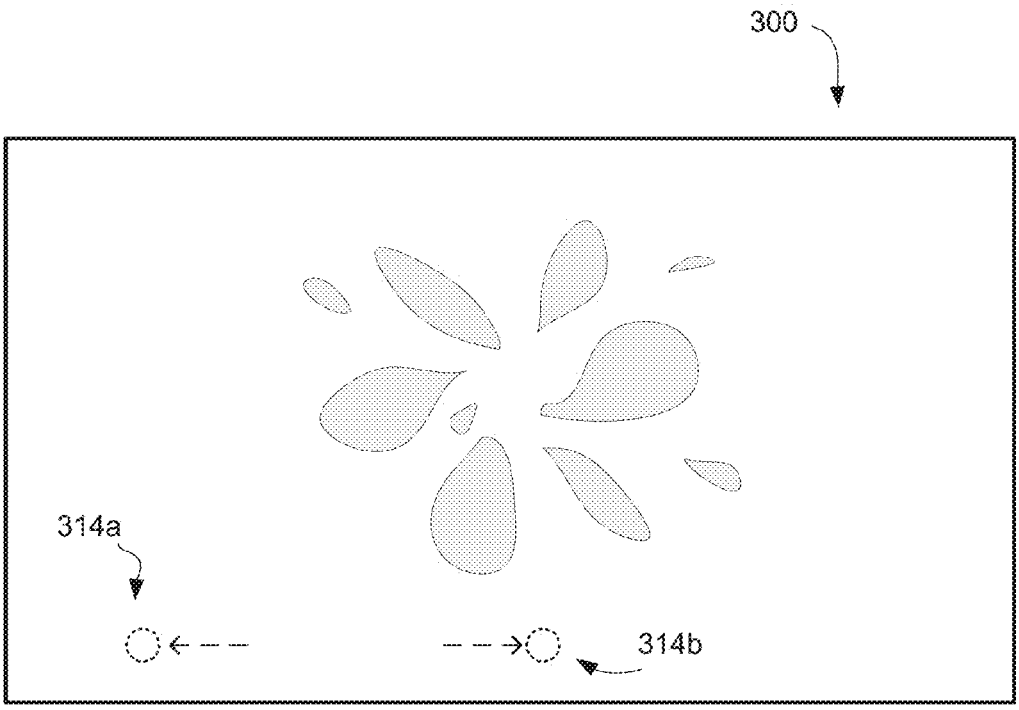

FIG. 9 illustrates a failure event in which the touch points 314*a*, 314*b* have been expanded so as to cause the diameter of the bubble 302 to exceed the failure threshold. As noted previously, the failure threshold may be selected pseudo-randomly so as to avoid predictability and to tailor outcomes to a target payout. The failure event, which in this example is the bursting of the bubble 302, may be animated on the GUI 300, and the reward value is reduced to zero.

Figure 10:
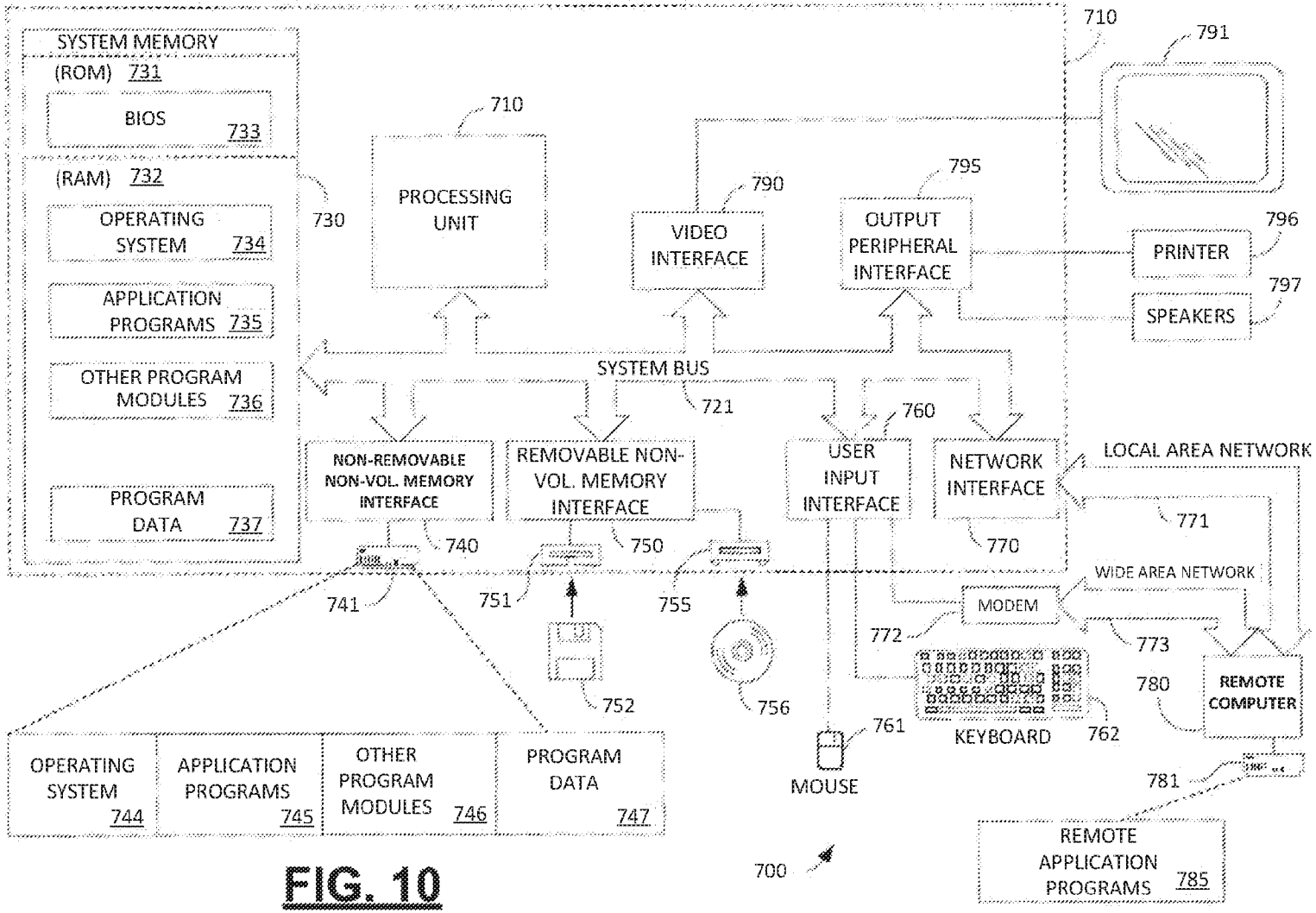
FIG. 10 shows, in block diagram form, one example of a computing device for implementing one embodiment of the gaming system.

FIG. 10 illustrates an example of a suitable computing system environment 700 in which some embodiments may be implemented. This computing system may be representative of a computing system that allows a suitable control system to implement the described techniques. However, it should be appreciated that the computing system environment 700 is only one example of a suitable computing environment and is not intended to suggest any limitation as to the scope of use or functionality of the described embodiments. Neither should the computing environment 700 be interpreted as having any dependency or requirement relating to any one or combination of components illustrated in the exemplary operating environment 700.

The embodiments are operational with numerous other general purpose or special purpose computing system environments or configurations. Examples of well-known computing systems, environments, and/or configurations that may be suitable for use with the described techniques include, but are not limited to, personal computers, server computers, hand-held or laptop devices, multiprocessor systems, microprocessor-based systems, set top boxes, programmable consumer electronics, network PCs, minicomputers, mainframe computers, distributed computing environments that include any of the above systems or devices, and the like.

The computing environment may execute computer-executable instructions, such as program modules. Generally, program modules include routines, programs, objects, components, data structures, etc., that perform particular tasks or implement particular abstract data types. The embodiments may also be practiced in distributed computing environments where tasks are performed by remote processing devices that are linked through a communications network. In a distributed computing environment, program modules may be located in both local and remote computer storage media including memory storage devices.

With reference to FIG. 10, an exemplary system for implementing the described techniques includes a general purpose computing device in the form of a computer 710. Components of computer 710 may include, but are not limited to, a processing unit 720, a system memory 730, and a system bus 721 that couples various system components including the system memory to the processing unit 720. The system bus 721 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

Computer 710 typically includes a variety of computer readable media. Computer readable media can be any available media that can be accessed by computer 710 and includes both volatile and nonvolatile media, removable and non-removable media. By way of example, and not limitation, computer readable media may comprise computer storage media and communication media. Computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can accessed by computer 710. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer readable media.

The system memory 730 includes computer storage media in the form of volatile and/or nonvolatile memory such as read only memory (ROM) 731 and random access memory (RAM) 732. A basic input/output system 733 (BIOS), containing the basic routines that help to transfer information between elements within computer 710, such as during start-up, is typically stored in ROM 731. RAM 732 typically contains data and/or program modules that are immediately accessible to and/or presently being operated on by processing unit 720. By way of example, and not limitation, FIG. 10 illustrates operating system 734, application programs 735, other program modules 736, and program data 737.

The computer 710 may also include other removable/non-removable, volatile/nonvolatile computer storage media. By way of example only, FIG. 10 illustrates a hard disk drive 741 that reads from or writes to non-removable, nonvolatile magnetic media, a magnetic disk drive 751 that reads from or writes to a removable, nonvolatile magnetic disk 752, and an optical disk drive 755 that reads from or writes to a removable, nonvolatile optical disk 756 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 741 is typically connected to the system bus 721 through a non-removable memory interface such as interface 740, and magnetic disk drive 751 and optical disk drive 755 are typically connected to the system bus 721 by a removable memory interface, such as interface 750.

The drives and their associated computer storage media discussed above and illustrated in FIG. 10 provide storage of computer readable instructions, data structures, program modules and other data for the computer 710. In FIG. 10, for example, hard disk drive 741 is illustrated as storing operating system 744, application programs 745, other program modules 746, and program data 747. Note that these components can either be the same as or different from operating system 734, application programs 735, other program modules 736, and program data 737. Operating system 744, application programs 745, other program modules 746, and program data 747 are given different numbers here to illustrate that, at a minimum, they are different copies. A user may enter commands and information into the computer 710 through input devices such as a keyboard 762 and pointing device 761, commonly referred to as a mouse, trackball or touch pad. Other input devices (not shown) may include a microphone, joystick, game pad, satellite dish, scanner, or the like. These and other input devices are often connected to the processing unit 720 through a user input interface 760 that is coupled to the system bus, but may be connected by other interface and bus structures, such as a parallel port, game port or a universal serial bus (USB). A touchscreen 791 is also connected to the system bus 721 via an interface, such as a video interface 790. The touchscreen 791 functions as both an output device for displaying text and graphics, and an input device for receiving use input via detected touch events. In addition to the touchscreen 791, computers may also include other peripheral output devices such as speakers 797 and printer 796, which may be connected through an output peripheral interface 795.

The computer 710 may operate in a networked environment using logical connections to one or more remote computers, such as a remote computer 780. The remote computer 780 may be a personal computer, a server, a router, a network PC, a peer device or other common network node, and typically includes many or all of the elements described above relative to the computer 710, although only a memory storage device 781 has been illustrated in FIG. 10. The logical connections depicted in FIG. 10 include a local area network (LAN) 771 and a wide area network (WAN) 773, but may also include other networks. Such networking environments are commonplace in offices, enterprise-wide computer networks, intranets and the Internet.

When used in a LAN networking environment, the computer 710 is connected to the LAN 771 through a network interface or adapter 770. When used in a WAN networking environment, the computer 710 typically includes a modem 772 or other means for establishing communications over the WAN 773, such as the Internet. The modem 772, which may be internal or external, may be connected to the system bus 721 via the user input interface 760, or other appropriate mechanism. In a networked environment, program modules depicted relative to the computer 710, or portions thereof, may be stored in the remote memory storage device. By way of example, and not limitation, FIG. 10 illustrates remote application programs 785 as residing on memory device 781. It will be appreciated that the network connections shown are exemplary and other means of establishing a communications link between the computers may be used.

The above-described embodiments can be implemented in any of numerous ways. For example, the embodiments may be implemented using hardware, software or a combination thereof. When implemented in software, the software code can be executed on any suitable processor or collection of processors, whether provided in a single computer or distributed among multiple computers. It should be appreciated that any component or collection of components that perform the functions described above can be generically considered as one or more controllers that control the above-discussed functions. The one or more controllers can be implemented in numerous ways, such as with dedicated hardware, or with general purpose hardware (e.g., one or more processors) that is programmed using microcode or software to perform the functions recited above.

In this respect, it should be appreciated that one implementation comprises at least one processor-readable storage medium (i.e., at least one tangible, non-transitory processor-readable medium, e.g., a computer memory (e.g., hard drive, flash memory, processor working memory, etc.), a floppy disk, an optical disc, a magnetic tape, or other tangible, non-transitory processor-readable medium) encoded with a computer program (i.e., a plurality of instructions), which, when executed on one or more processors, performs at least the above-discussed functions. The processor-readable storage medium can be transportable such that the program stored thereon can be loaded onto any computer resource to implement functionality discussed herein. In addition, it should be appreciated that the reference to a computer program which, when executed, performs above-discussed functions, is not limited to an application program running on a host computer. Rather, the term "computer program" is used herein in a generic sense to reference any type of computer code (e.g., software or microcode) that can be employed to program one or more processors to implement above-discussed functionality.

The phraseology and terminology used herein is for the purpose of description and should not be regarded as limiting. The use of "including," "comprising," "having," "containing," "involving," and variations thereof, is meant to encompass the items listed thereafter and additional items. Use of ordinal terms such as "first," "second," "third," etc., in the claims to modify a claim element does not by itself connote any priority, precedence, or order of one claim element over another or the temporal order in which acts of a method are performed. Ordinal terms are used merely as labels to distinguish one claim element having a certain name from another element having a same name (but for use of the ordinal term), to distinguish the claim elements.

Having described several embodiments of the invention, various modifications and improvements will readily occur to those skilled in the art. Such modifications and improvements are intended to be within the spirit and scope of the invention. Accordingly, the foregoing description is by way of example only, and is not intended as limiting. The invention is limited only as defined by the following claims and the equivalents thereto.

The invention claimed is:

1. A method of controlling a gaming system, the gaming system having a touchscreen for displaying graphics and receiving user input, the method comprising:

determining, using a processor, a randomized failure threshold;

displaying a graphical image and an initial reward value on the touchscreen, wherein the graphical image represents an object;

detecting two spaced-apart simultaneously occurring touch inputs on the touchscreen;

while the two spaced-apart touch inputs are still detected on the touchscreen, detecting an increase in a distance between the two touch inputs and, in response, based on the increase in the distance, increasing a stress value and modifying the displayed graphical image to indicate increased stress on the object, scaling the reward value proportional to the increase in the distance, and determining whether the stress value exceeds the randomized failure threshold and, if so, zeroing the reward value and animating a failure event on the touchscreen; and, if at least one of the two spaced-apart touch inputs ceases to be detected on the touchscreen prior to the stress value exceeding the randomized failure threshold, displaying a selectable option to accept the scaled reward value.

2. The method of claim 1, wherein the gaming system includes a history of payouts and a target payout, and wherein the determining of the randomized failure threshold is at least partly based upon the history of payouts and the target payout.

3. The method of claim 1, wherein the gaming system includes a history of payouts and a target payout, and wherein the proportional scaling of the reward value is at a rate at least partly based upon the history of payouts and the target payout.

4. The method of claim 1, wherein increasing the stress value comprises increasing the stress value based upon the increase in the distance.

5. The method of claim 4, wherein the increase in the stress value is proportional to the increase in the distance.

6. The method of claim 4, wherein the increase in the stress value is nonlinearly related to the increase in the distance.

7. The method of claim 1, wherein the graphical image comprises a bubble, wherein modifying the displayed graphical image to indicate increased stress on the object comprises expanding the size of the bubble, and wherein animating a failure event comprises animating the bubble popping.

8. The method of claim 1, further comprising detecting a decrease in the distance between the two touch inputs and, in response, maintaining the stress value, the graphical image, and the scaled reward value unchanged.

9. The method of claim 1, wherein increasing the stress value and modifying the displayed graphical image to indicate increased stress on the object includes modeling a force applied to the object, and wherein the failure event comprises modeled physical failure of the object under the applied force.

10. A gaming system comprising:

a touchscreen;

a processor;

a memory; and a gaming application stored in the memory and executable by the processor, wherein, when executed, the gaming application causes the processor to determine a randomized failure threshold;

display a graphical image and an initial reward value on the touchscreen, wherein the graphical image represents an object;

detect two spaced-apart simultaneously occurring touch inputs on the touchscreen;

while the two spaced-apart touch inputs are still detected on the touchscreen, detect an increase in a distance between the two touch inputs and, in response, based on the increase in the distance, increase a stress value and modify the displayed graphical image to indicate increased stress on the object, scale the reward value proportional to the increase in the distance, and determine whether the stress value exceeds the randomized failure threshold and, if so, zero the reward value and animate a failure event on the touchscreen; and, if at least one of the two spaced-apart touch inputs ceases to be detected on the touchscreen prior to the stress value exceeding the randomized failure threshold, display a selectable option to accept the scaled reward value.

11. The gaming system of claim 10, wherein the memory stores a history of payouts and a target payout, and wherein the processor is to determine the randomized failure threshold at least partly based upon the history of payouts and the target payout.

12. The gaming system of claim 10, wherein the memory stores a history of payouts and a target payout, and wherein the processor is to proportionally scale the reward value at a rate at least partly based upon the history of payouts and the target payout.

13. The gaming system of claim 10, wherein the processor is to increase the stress value based upon the increase in the distance.

14. The gaming system of claim 13, wherein the increase in the stress value is proportional to the increase in the distance.

15. The gaming system of claim 13, wherein the increase in the stress value is nonlinearly related to the increase in the distance.

16. The gaming system of claim 10, wherein the graphical image comprises a bubble, wherein the processor is to modify the displayed graphical image to indicate increased stress on the object by expanding the size of the bubble, and wherein the processor is to animate a failure event by animating the bubble popping.

17. The gaming system of claim 10, wherein the gaming application, when executed, further causes the processor to detect a decrease in the distance between the two touch inputs and, in response, maintain the stress value, the graphical image, and the scaled reward value unchanged.

18. The gaming system of claim 10, further including a cabinet housing the touchscreen, the processor and the memory.

19. The gaming system of claim 10, wherein increasing the stress value and modifying the displayed graphical image to indicate increased stress on the object includes modeling a force applied to the object, and wherein the failure event comprises modeled physical failure of the object under the applied force.

20. A non-transitory computer-readable medium having stored thereon processor executable instructions that, when executed, cause one or more processors to carry out the method comprising:

determining, using a processor, a randomized failure threshold;

displaying a graphical image and an initial reward value on a touchscreen, wherein the graphical image represents an object;

detecting two spaced-apart simultaneously occurring touch inputs on the touchscreen;

while the two spaced-apart touch inputs are still detected on the touchscreen, detecting an increase in a distance between the two touch inputs and, in response, based on the increase in the distance, increasing a stress value and modifying the displayed graphical image to indicate increased stress on the object, scaling the reward value proportional to the increase in the distance, and determining whether the stress value exceeds the randomized failure threshold and, if so, zeroing the reward value and animating a failure event on the touchscreen; and, if at least one of the two spaced-apart touch inputs ceases to be detected on the touchscreen prior to the stress value exceeding the randomized failure threshold, displaying a selectable option to accept the scaled reward value.

* * * * *